US010465944B2

(12) United States Patent
Okuda et al.

(10) Patent No.: US 10,465,944 B2
(45) Date of Patent: Nov. 5, 2019

(54) HEAT EXCHANGER AND PRODUCTION METHOD OF THE HEAT EXCHANGER

(71) Applicant: NORITZ CORPORATION, Hyogo (JP)

(72) Inventors: Shoji Okuda, Kobe (JP); Hideyuki Fujisawa, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 15/896,533

(22) Filed: Feb. 14, 2018

(65) Prior Publication Data

US 2018/0245817 A1 Aug. 30, 2018

(30) Foreign Application Priority Data

Feb. 24, 2017 (JP) ..... 2017-033743

(51) Int. Cl.

| | |
|---|---|
| ***F28D 7/10*** | (2006.01) |
| ***F24H 9/12*** | (2006.01) |
| ***B21D 39/06*** | (2006.01) |
| ***F28F 1/02*** | (2006.01) |
| ***F28F 9/08*** | (2006.01) |

(Continued)

(52) U.S. Cl.

CPC ..... *F24H 9/122* (2013.01); *B21D 39/06* (2013.01); *B21D 53/02* (2013.01); *B21D 53/08* (2013.01); *F24H 1/40* (2013.01); *F24H 9/0015* (2013.01); *F24H 9/0026* (2013.01); *F28D 7/1623* (2013.01); *F28D 21/0007* (2013.01); *F28F 1/025* (2013.01); *F28F 9/0224* (2013.01); *F28F 9/08* (2013.01); *F28F 9/14* (2013.01); *F28F 9/182* (2013.01); *B21D 39/20* (2013.01); *F28F 9/0229* (2013.01); *F28F 2240/00* (2013.01); *F28F 2275/125* (2013.01)

(58) Field of Classification Search

CPC .... F28F 9/14; F28F 9/16; F28F 9/0224; F28F 9/182; F28F 9/0229; F28F 2275/12; F28F 2275/125; F28F 2240/00; F24H 9/0015; F24H 9/0026; F24H 1/40; F28D 21/0007; F28D 7/1623; B21D 53/02

See application file for complete search history.

(56) References Cited

U.S. PATENT DOCUMENTS

2017/0131043 A1* 5/2017 Contet ..... F28F 9/0224

FOREIGN PATENT DOCUMENTS

| | | |
|---|---|---|
| JP | 5096092 B2 | 12/2012 |
| JP | 2017-026286 A | 2/2017 |

* cited by examiner

*Primary Examiner* — Henry T Crenshaw
*Assistant Examiner* — Kamran Tavakoldavani
(74) *Attorney, Agent, or Firm* — Studebaker & Brackett PC

(57) ABSTRACT

A heat transfer tube of a heat exchanger is provided with a first and a second annular convex portions of which outer diameters are partially expanded. The first annular convex portion is positioned on an inner face side of a side plate portion of a case of the heat exchanger and is engaged with a circumferential edge portion of a first hole portion provided for the side plate portion, or the first annular convex portion contacts under pressure with an inner circumferential face of the first hole portion. The second annular convex portion is positioned on an outer face side of a header constituting member and is engaged with a circumferential edge portion of a second hole portion. Thus the side plate portion, the heat transfer tube, and a header are relatively fixed by a simple means.

13 Claims, 8 Drawing Sheets

(51) Int. Cl.

| | |
|---|---|
| ***F28F 9/14*** | (2006.01) |
| ***B21D 53/08*** | (2006.01) |
| ***B21D 53/02*** | (2006.01) |
| ***F24H 1/40*** | (2006.01) |
| ***F28F 9/02*** | (2006.01) |
| ***F28F 9/18*** | (2006.01) |
| ***F28D 7/16*** | (2006.01) |
| ***F28D 21/00*** | (2006.01) |
| ***F24H 9/00*** | (2006.01) |
| *B21D 39/20* | (2006.01) |

Comparison Example

HEAT EXCHANGER AND PRODUCTION METHOD OF THE HEAT EXCHANGER

BACKGROUND OF THE INVENTION

Field of the Invention

The present invention relates to a heat exchanger for heating water in a water heating apparatus and a production method of the heat exchanger.

Description of the Related Art

One embodiment of a heat exchanger is disclosed in Patent Literature 1.

The heat exchanger disclosed in Patent Literature 1 is incorporated into a water heating apparatus for heating water, and houses a plurality of heat transfer tubes in a case into which combustion gas flows. A plurality of hole portions are configured to penetrate a side plate portion of the case, and end portions of the heat transfer tubes are inserted into the hole portions to go out of the case. A header is attached to an outer face portion of the case for flowing water into the heat transfer tubes and for flowing heated water out of the heat transfer tubes. The header is configured in such a manner that a header cover member is joined to a header constituting member (a header base member) fixed to the end portions of the heat transfer tubes. The side plate portion of the case, the heat transfer tubes and the header are fixed with each other by a brazing means.

However, the above-mentioned related art has a room for improvement as below.

When the side plate portion of the case, the heat transfer tubes and the header are brazed, they are desired to be fixed (temporally fixed) with each other in advance. When the heat exchanger is carried in a heating furnace for brazing, such temporal fixing prevents inappropriate displacement of the above-mentioned members. However, it has been conventionally difficult to execute such fixing simply and rapidly and there have been problems.

Patent Literature 2 discloses a means in which a tube body penetrating a plate member is expanded, the plate member is interposed between two expanded tube portions, and the tube body is fixed to the plate member. Such a means is only for fixing the plate member and the tube body with each other. It is difficult to appropriately fix the side plate portion of the case, the heat transfer tubes and the header (at least the header constituting member being a part of the header) of the heat exchanger.

CITATION LIST

Patent Literature 1: Japanese Unexamined Patent Application Publication No. 2017-26286

Patent Literature 2: Japanese Patent No. 5096092

SUMMARY OF THE INVENTION

An object of the present invention is to provide a heat exchanger in which a side plate portion of a case, a heat transfer tube, and a header are relatively fixed in an appropriate manner by a simple means and to a production method of the heat exchanger.

In order to solve the above-mentioned problems, the following technical measures are provided.

A heat exchanger proposed in the first aspect of the present invention has a case having a side plate portion through which a first hole portion penetrates, a heating medium being supplied in the case; a heat transfer tube, an end portion of the heat transfer tube being inserted into the first hole portion; a header constituting member provided on an outer face side of the side plate portion, the header constituting member having a second hole portion into which the end portion of the heat transfer tube is inserted; and a first annular convex portion and a second annular convex portion that are provided for the heat transfer tube, outer diameters of the first and the second annular convex portions being partially expanded, the first and the second annular convex portions relatively fixing the side plate portion of the case, the heat transfer tube, and the header constituting member. The first annular convex portion is positioned on an inner face side of the side plate portion and is engaged with a circumferential edge portion of the first hole portion, or the first annular convex portion is positioned in the first hole portion and contacts under pressure with an inner circumferential face of the first hole portion. The second annular convex portion is positioned on an outer face side of the header constituting member and is engaged with a circumferential edge portion of the second hole portion.

Preferably. the heat exchanger of the present invention further has at least one header for water inflow or water outflow of the heat transfer tube. The header has a header base member having a first base plate portion in a flat shape and a first flange portion in an annular shape, the first base plate portion being arranged along the outer face of the side plate portion of the case, the first flange portion being connected to an outer circumferential edge of the first base plate portion and rising outward; and a header cover member having a second base plate portion in a flat shape and a second flange portion in an annular shape, the second base plate portion facing the first base plate portion, the second flange portion being connected to an outer circumferential edge of the second base plate portion and being fitted to the first flange portion. The first base plate portion is provided with the second hole portion and the header base member comprises the header constituting member.

Preferably, the first annular convex portion has a tapered portion extending in an axial length direction of the heat transfer tube in such a manner that an outer diameter of the tapered portion is reduced toward an inner side of the case.

Preferably, the side plate portion and the header constituting member are arranged so as to be apart from each other in the axial length direction of the heat transfer tube. A part of the first annular convex portion close to an outer side of the case is positioned on an outer side of the side plate portion and is engaged with an inner face side of the header constituting member, so that a part of the header constituting member is interposed between the first and the second annular convex portions. The tapered portion of the first annular convex portion contacts under pressure with the inner circumferential face of the first hole portion.

Preferably, a spacer is interposed between the side plate portion and the header constituting member, the spacer having a third hole portion into which the heat transfer tube is inserted. The tapered portion also contacts under pressure with an inner circumferential face of the third hole portion.

Preferably, in the heat exchanger of the present invention, the heat transfer tube includes an inner heat transfer tube arranged in the case and an outer heat transfer tube arranged outside of the case so as to contact with an outer face portion of the case, the first and the second annular convex portions are provided for each of the inner heat transfer tube and the outer heat transfer tube.

Preferably, the inner and the outer heat transfer tubes are communicated with each other and are configured in such a manner that water supplied into one of the inner and the outer heat transfer tubes passes through the other of the inner and the outer heat transfer tubes.

Preferably, the header constituting member is configured to contact with an outer face portion of the side plate portion, and a part of the header constituting member and a part of the side plate portion are respectively interposed between the first and the second annular convex portions.

A production method of a heat exchanger proposed in the second aspect of the present invention includes the steps of inserting an end portion of a heat transfer tube into a first hole portion provided for a side plate portion of a case in which a heating medium is supplied and into a second hole portion of a header constituting member arranged on an outer face side of the side plate portion; and relatively fixing the side plate portion, the heat transfer tube, and the header constituting member. In the fixing step a first annular convex portion and a second annular convex portion are provided by partially expanding at least two portions of the heat transfer tube, the first annular convex portion being positioned on an inner face side of the side plate portion and being engaged with a circumferential edge portion of the first hole portion or the first annular convex portion being positioned in the first hole portion and contacting under pressure with an inner circumferential face of the first hole portion, the second annular convex portion being positioned on an outer face side of the header constituting member and being engaged with a circumferential edge portion of the second hole portion.

Preferably, the heat transfer tube is expanded by a split punch, and the split punch has a deformable portion divided into a plurality of segments around a central axis, and an outer circumferential face of the deformable portion has a first convex portion and a second convex portion for respectively forming the first and the second annular convex portions.

Preferably, the split punch has the first convex portion at a tip end portion, and the first convex portion has a tapered portion extending in an axial length direction of the split punch in such a manner that an outer diameter of the tapered portion is reduced toward a tip end side.

Preferably, the heat transfer tube includes an elliptic tube, and the split punch is configured in such a manner that outlines of the first and the second convex portions are elliptic corresponding to the elliptic tube seen along an axial length directions, and a slit for dividing the deformable portion into the segments is in a shape of cross with a long axis and a short axis of ellipse.

Preferably, a plurality of heat transfer tubes are used as the heat transfer tube, and a plurality of split punches are used as the split punch and are simultaneously expand the plurality of heat transfer tubes.

The other characteristics and advantages of the present invention are apparent from the following explanation of the preferred embodiments referring to the attached drawings.

DETAILED DESCRIPTION OF THE PREFERRED EMBODIMENT

The preferred embodiments of the present invention are concretely explained referring to attached drawings.

Figure 1:
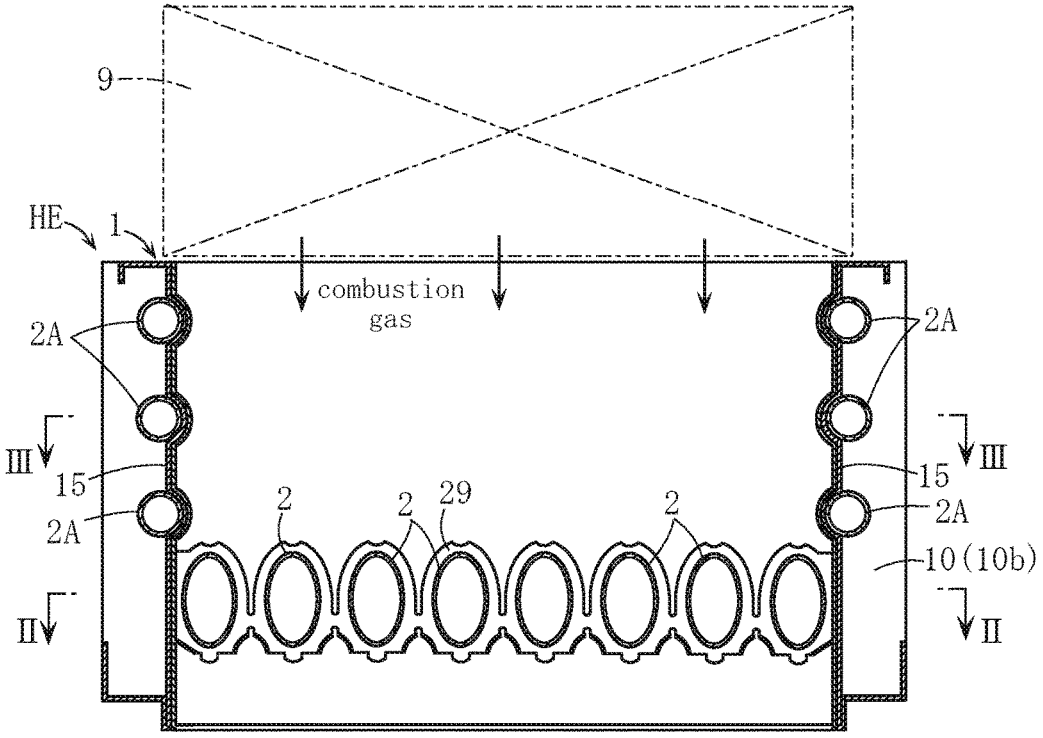
FIG. 1 is a front sectional view illustrating one embodiment of a heat exchanger of the present invention.
Figure 2:
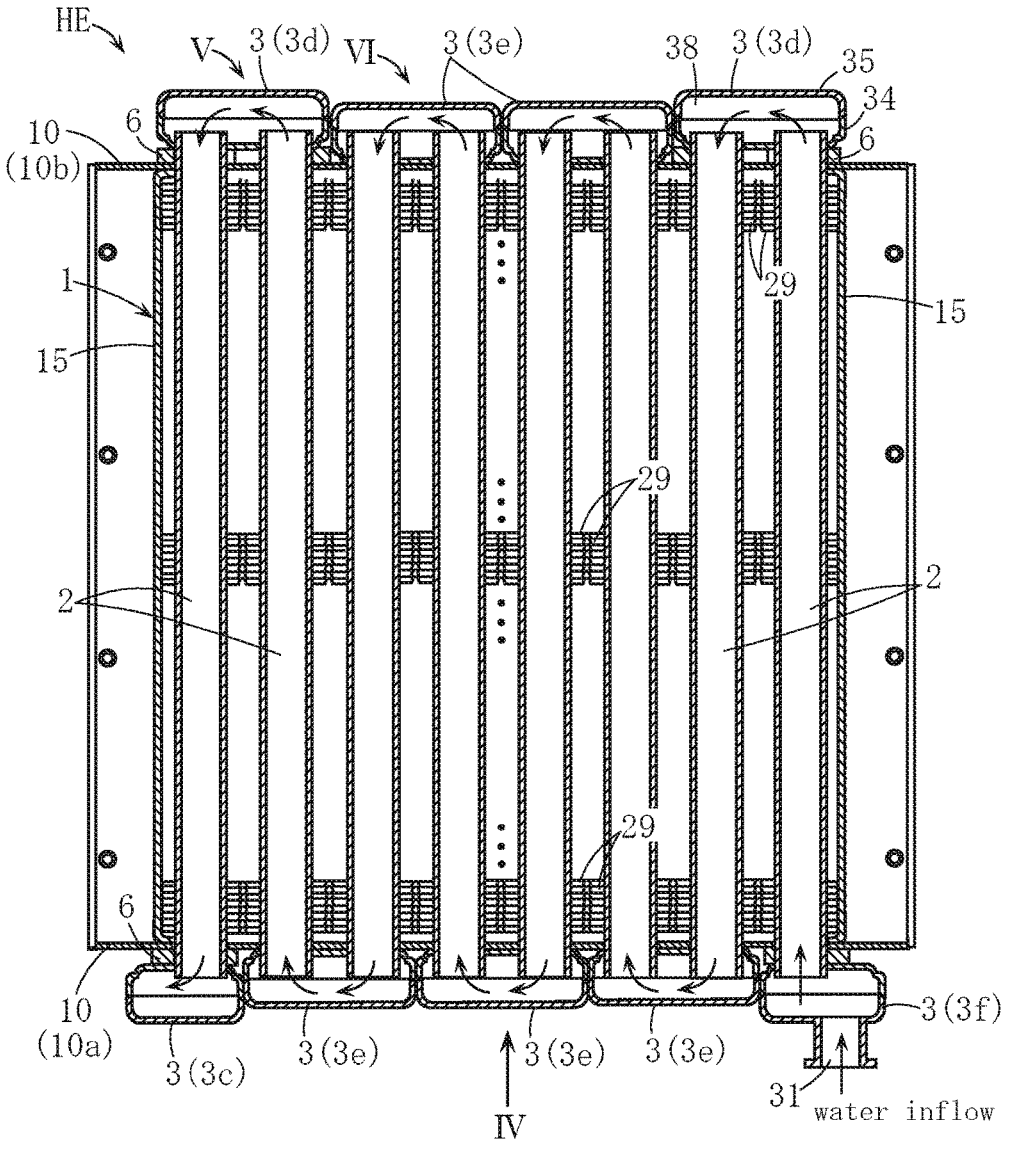
FIG. 2 is a plan sectional view taken along a line II to II in FIG. 1.
Figure 3:
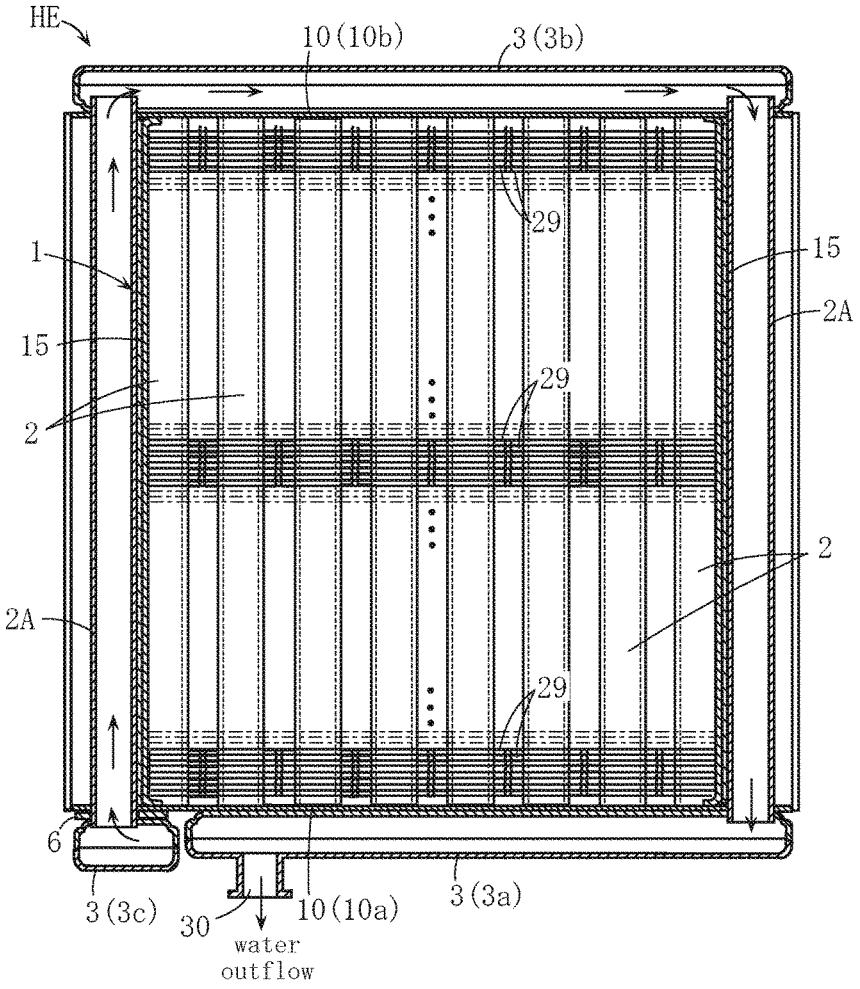
FIG. 3 is a plan sectional view taken along a line III to III in FIG. 1.
Figure 4:
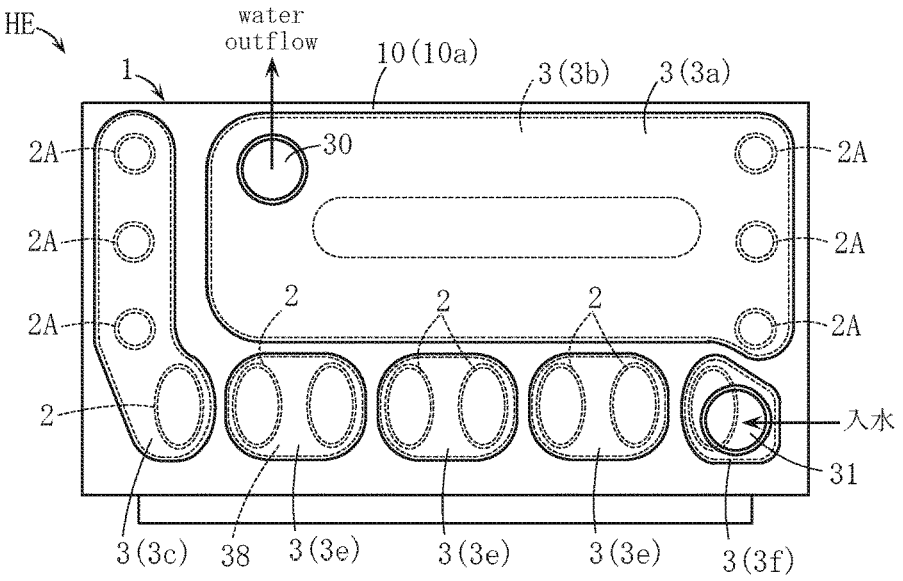
FIG. 4 is a front view taken along an arrow IV in FIG. 2.

In FIG. 1, a heat exchanger HE of an embodiment of the present invention is configured to be incorporated into, for example, a water heating apparatus and to be used for heating water to be supplied. The heat exchanger HE has a case 1 in the shape of substantial cuboid with an upper face and a lower face open, a plurality of heat transfer tubes 2 (inner heat transfer tubes) that are housed in the case 1 and are configured to respectively penetrate a plurality of plate-like fins 29, a plurality of heat transfer tubes 2A (outer heat transfer tubes) that are arranged outside of the case 1 so as to contact with a pair of right and left side wall portions 15 of the case 1, and a plurality of headers 3 (3*a* to 3*f*), as illustrated in FIG. 2 to FIG. 4. A burner 9 is provided on the case 1 and combustion gas (one example of heating medium) generated by the burner 9 is supplied into the case 1.

As illustrated in FIG. 2 and FIG. 3, the case 1 has a front and a rear side plate portions 10 (10*a*, 10*b*) of which each width is larger than the width between the pair of side wall portions 15.

The side plate portions 10 are fixed with both end portions of the heat transfer tubes 2, 2A in the longitudinal direction and are provided with the headers 3 (3*a* to 3*f*). As illustrated in FIG. 1, the inner heat transfer tubes 2 are elliptic tubes that are hollow in a sectional view and are long in the vertical height direction. The outer heat transfer tubes 2A are circular tubes.

In the heat exchanger HE, as illustrated in FIG. 2 to FIG. 4, water such as tap water to be heated is supplied to a water inlet 31 of the header 3*f* for water-inflow provided for the front side plate portion 10 (10*a*). Water flows from the header 3*f*, meanders through the plurality of inner heat transfer tubes 2 and the headers 3*d*, 3*e*, reaches the header 3*c*, flows through the outer heat transfer tube 2A (heat transfer tube 2A on the left side in FIG. 3 and FIG. 4) connected with the header 3*c*, and flows into the header 3*b* provided for the rear side plate portion 10 (10*b*). Then, water flows from the header 3*b* through another outer heat transfer tube 2A (heat transfer tube 2A on the right side in FIG. 3 and FIG. 4) and reaches the header 3*a* for water-outflow. As mentioned above, combustion gas is supplied into the case 1 from the burner 9. The above-mentioned water is heated while flowing in the above-mentioned routes and the heated water is discharged toward a desired place from a water outlet 30 of the header 3*a* for water-outflow. The flowing direction of water in the heat exchanger HE can be opposite to the above-mentioned embodiment, namely the header 3*a* can be for water-inflow and the header 3*f* can be for water-outflow.

The outer heat transfer tubes 2A have a function of preventing thermal damage of each side wall portion 15 caused by being heated into excessive high temperature by combustion gas. On the other hand, the outer heat transfer tubes 2A also have a function of absorbing heat of each side wall portion 15 and of heating water, so that the outer heat transfer tubes 2A are included in the concept of the heat transfer tubes in the present invention. The headers 3*a*, 3*b* are larger than the other headers 3*c* to 3*f* and are provided so as to contact with the front and the rear side plate portions 10*a*, 10*b*. Such a configuration serves for preventing thermal damage of the front and the rear side plate portions 10*a*, 10*b* and for improving heating efficiency of water.

Figure 5:
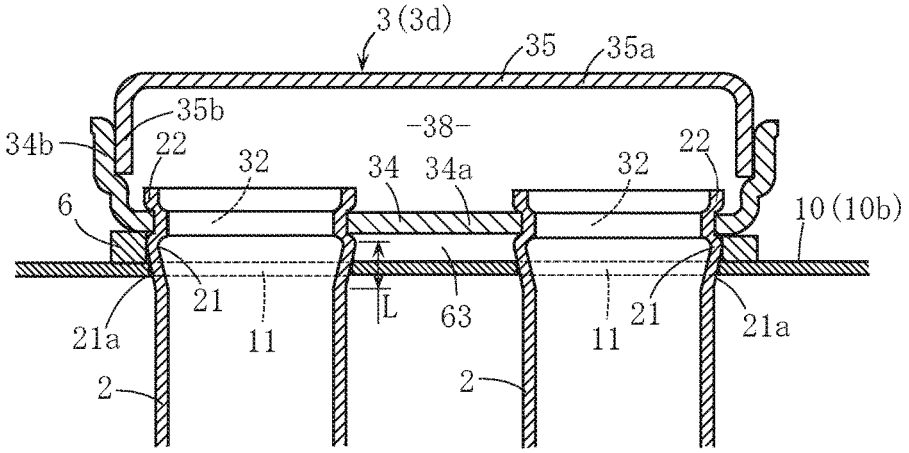
FIG. 5 is an enlarged sectional view of a region indicated with a reference numeral V in FIG. 2.
Figure 6:
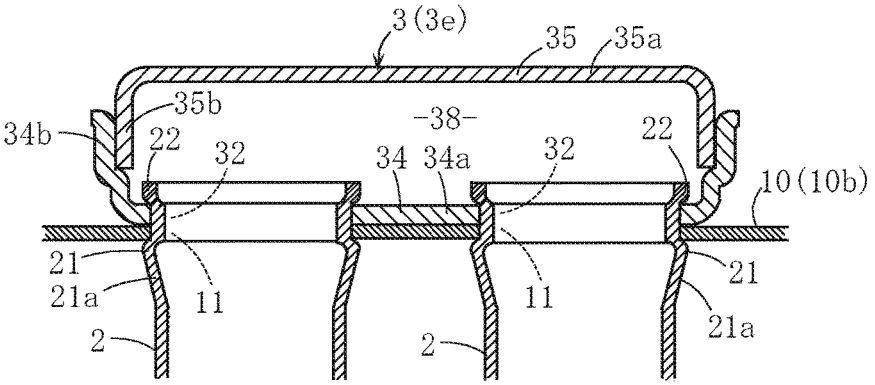
FIG. 6 is an enlarged sectional view of a region indicated with a reference numeral VI in FIG. 2.

As illustrated in FIG. 5 and FIG. 6, the header 3 is constituted by joining a header base member 34 and a header cover member 35. A chamber 38 communicating with the inside of the heat transfer tubes 2, or the heat transfer tubes 2A, is formed inside the header 3. The header base member 34 has a first base plate portion 34*a* like a flat plate and a first flange portion 34*b* that is connected with an outer circumferential edge of the first base plate portion 34*a* so as to rise outward and to be annular. The header cover member 35 has a second base plate portion 35*a* like a flat plate and a second flange portion 35*b* that is connected with an outer circumferential edge of the second base plate portion 35*a* so as to rise inward and to be annular. When the first and the second flange portions 34*b*, 35*b* are fitted, the header base member 34 and the header cover member 35 are combined, and the header 3 is constituted. The header base member 34 has a second hole portion 32 to be mentioned later and corresponds to one example of a "header constituting member" in the present invention.

Preferably, the side plate portion 10 (10*a*, 10*b*) of the case 1, the heat transfer tubes 2, 2A, and the header 3 are finally fixed by brazing or welding and are also mechanically fixed with each other. In the heat exchanger HE of the embodiment of the present invention, such a fixing structure is broadly categorized into a first and a second fixing structures illustrated in FIG. 5 and FIG. 6. FIG. 5 illustrates a typical example of a structure in which the header 3 (3*d*) is attached. FIG. 6 illustrates a typical example of a structure in which the header 3 (3*e*) is attached.

In the first fixing structure illustrated in FIG. 5, a spacer 6 is provided between the side plate portion 10 of the case 1 and the header 3. The spacer 6 is used in such a case that the projecting dimension of the header 3 toward the outside of the side plate portion 10 is made greater than that in the second fixing structure illustrated in FIG. 6. The end portion of the heat transfer tube 2 is sequentially inserted into a first and a second hole portions 11, 32 respectively provided for the side plate portion 10 and the header base member 34 (the first base plate portion 34*a*). The spacer 6 has a third hole portion 63 into which the heat transfer tubes 2 are inserted.

The heat transfer tube 2 has a first and a second annular convex portions 21, 22 of which outer diameters are partially expanded.

The first annular convex portion 21 has a tapered portion 21*a* of which outer diameter is reduced toward an inner side of the case 1 (lower side in FIG. 5) and which extends in appropriate length L in the axial length direction of the heat transfer tube 2. An outer circumferential face of the tapered portion 21*a* contacts under pressure with an inner circumferential face of the first hole portion 11 of the side plate portion 10, so that the heat transfer tube 2 is fixed to the side plate portion 10. Preferably, an inner circumferential edge of the first hole portion 11 partially bites into the outer circumferential face of the tapered portion 21*a*.

In addition, a part of the first annular convex portion 21 bulges outward in the radial direction of the heat transfer tube 2 in an area between the side plate portion 10 and the header base member 34. An outer circumferential face of the bulging portion contacts under pressure with an inner circumferential face of the third hole portion 63 of the spacer 6, so that the spacer 6 and the heat transfer tube 2 are relatively fixed in the direction along an outer face of the side plate portion 10. The bulging portion of the first annular convex portion 21 is positioned on an inner side (downward face in FIG. 5) of the header base member 34 and is engaged with a circumferential edge portion of the second hole portion 32.

The second annular convex portion 22 is short in the axial length direction of the heat transfer tube 2 unlike the first annular convex portion 21, is positioned on an outer face side of the header base member 34, and is engaged with the circumferential edge portion of the second hole portion 32. The header base member 34 is held between the first and the second annular convex portions 21, 22, and the heat transfer tube 2 and the header base member 34 are relatively fixed. Thus, the side plate portion 10, the heat transfer tube 2, the header base member 34, and the spacer 6 are relatively fixed.

In the second fixing structure illustrated in FIG. 6, unlike the first fixing structure, the header base member 34 directly contacts with the outer face of the side plate portion 10 without using the spacer 6. The second annular convex portion 22 is positioned on the outer face side of the header base member 34 and is engaged with the circumferential edge portion of the second hole portion 32, like the first fixing structure illustrated in FIG. 5. On the other hand, the first annular convex portion 21 is positioned on an inner face side of the side plate portion 10 and is engaged with a circumferential edge portion of the first hole portion 11. Thus, the header base member 34 and the side plate portion 10 are held between the first and the second annular convex portions 21, 22; and the side plate portion 10, the heat transfer tube 2, and the header base member 34 are relatively fixed.

In the heat exchanger HE, the first fixing structure is applied to attachment portions of the headers 3 (3*c*, 3*d*, 3*f*) and the second fixing structure is applied to other headers 3 (3*a*, 3*b*, 3*e*).

Next, one embodiment of a production method of the above-mentioned heat exchanger HE is explained.

In producing the heat exchanger HE, procedures for obtaining the first and the second fixing structures (corresponding to the fixing step in the present invention) as illustrated in FIG. 5 and FIG. 6 are executed. In the procedures, the heat transfer tubes 2 are expanded by the operations illustrated in FIG. 7A to FIG. 7C, FIG. 8A, and FIG. 8B, and the first and the second annular convex portions 21, 22 are formed. A split punch 5 illustrated in FIG. 9A to FIG. 9C, FIG. 10A and FIG. 10B is used for the expansion and is explained at first for easy understanding.

The split punch 5 is in the shape of a tube into which a mandrel 4 is inserted and has a plurality of slits 53 extending toward a base end side from a tip end portion. By such a configuration, the split punch 5 is divided into a plurality of segments 50*a* (4 segments in the embodiment of the present invention) around the central axis. Part of the split punch 5 close to a tip end in the axial length direction is a deformable portion 50 capable of expanding or contracting in the radial direction.

An outer circumferential face of the deformable portion 50 is formed with a first and a second convex portions 51, 52 for forming the first and the second annular convex portions 21, 22 mentioned above. An area of the split punch 5 close to the tip end constitutes the first convex portion 51, and the first convex portion 51 has a tapered portion 51*a* extending in appropriate length along the axial length direction of the split punch 5 so as to reduce the outer diameter toward the tip end side. The second convex portion 52 is provided close to the base end side further than the first convex portion 51 apart from the first convex portion 51 and is a substantially annular convex portion of which vertical section is substantially semicircular. The inner heat transfer tube 2 is an elliptic tube, so that the outer shapes of the first and the second convex portions 51, 52 seen along the axial length direction are in the shape of ellipse. On the other hand, in the split punch 5 for the heat transfer tube 2A in the shape of circle, the outer shapes of the first and the second convex portions 51, 52 are circular.

A tip end portion of the mandrel 4 is, for example, like a circular cone, constitutes a wedge portion 40 of which diameter or width increases toward a base end side from the tip end portion, and is positioned on an inner side of the deformable portion 50 of the split punch 5. When the mandrel 4 is advanced relative to the split punch 5, the state is changed from FIG. 10A to FIG. 10B. Namely, the segments 50*a* are pressed apart by the wedge portion 40.

Figure 10A:
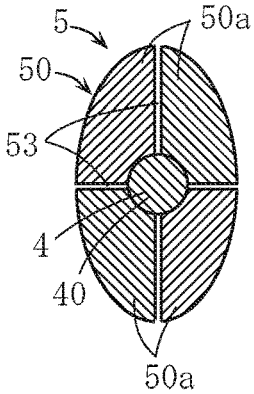
FIG. 10A is a sectional view taken along a line Xa to Xa in FIG. 9A.

As shown in FIG. 10A, the slits 53 of the split punch 5 are formed like a cross by the long axis and the short axis of the elliptic outer shape of the first and the second convex portions 51, 52. The following advantages are expected by such a configuration.

Figure 10B:
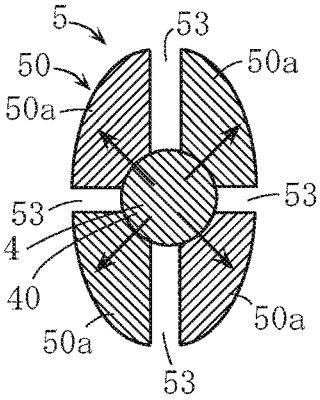
FIG. 10B is a plan sectional view illustrating operating condition of the structure illustrated in FIG. 10A.
Figure 11:
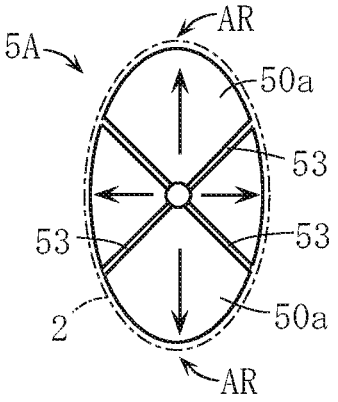
FIG. 11 explains a comparison example of a split punch relative to that in FIG. 9A to FIG. 9C, FIG. 10A and FIG. 10B.

When the slits 53 of the split punch SA are misaligned with a comparatively large angle relative to the long and the short axes of the ellipse as illustrated in the comparison example in FIG. 11, the segments 50*a* are displaced in the long and the short axis directions. On the other hand, an area AR of the elliptic heat transfer tube 2 of which tip end is gradually narrowed is a hardly deformable area. In the comparison example, the segment 50*a* is pressed in a substantially vertical manner to the hardly deformable area AR and large force is required for expanding tubes. On the other hand, in the embodiment of the present invention, as shown in FIG. 10B, the heat transfer tube 2 is expanded so as to prevent the segment 50*a* from vertically pressing the area AR. Therefore, the tube is expanded with a relatively small force. In the embodiment of the present invention, the above-mentioned split punch 5 can be the one corresponding to the comparison example.

Figure 7A:
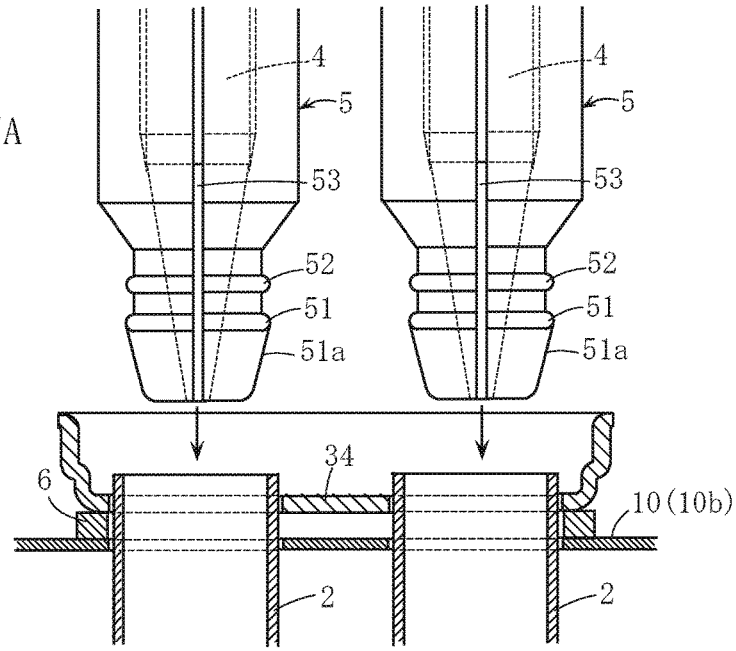
FIG. 7A to FIG. 7C are essential sectional views illustrating one embodiment of process procedures of a region illustrated in FIG. 5.
Figure 7B:
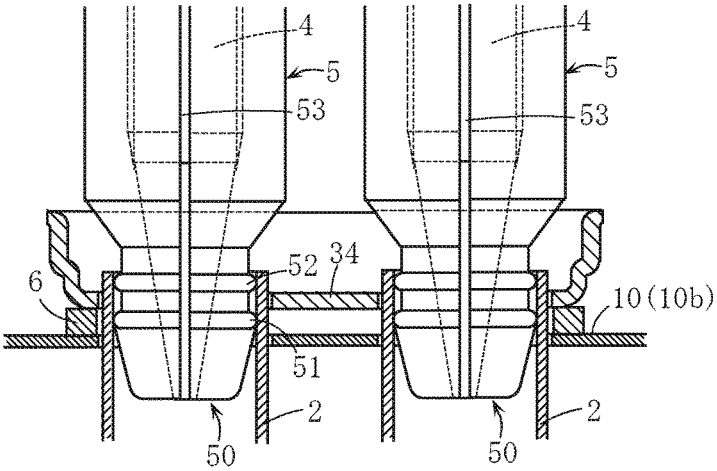
Figure 7C:
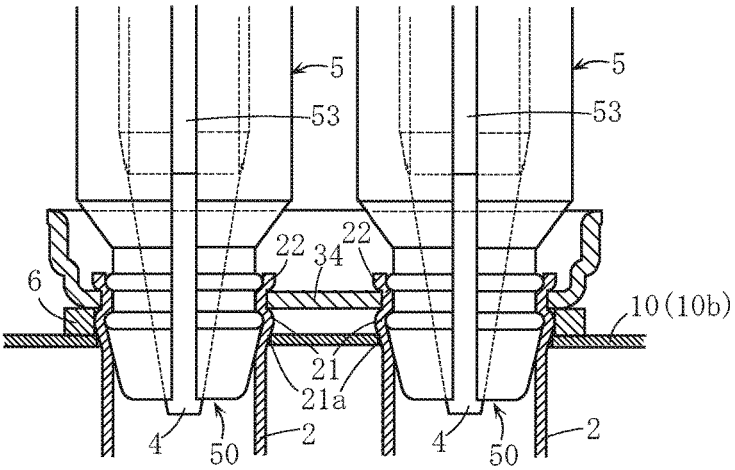

For obtaining the first fixing structure illustrated in FIG. 5 in producing the heat exchanger HE, the heat transfer tube 2 is expanded as illustrated in FIG. 7A to FIG. 7C using the above-mentioned split punch 5.

Specifically, the header base member 34 is not joined with the header cover member 35 before the expansion operation of the heat transfer tube 2 as illustrated in FIG. 7A. The basic positional relation of the side plate portion 10 of the case 1, the heat transfer tube 2, the spacer 6 and the header base member 34 is the same as that explained referring to FIG. 5. The split punch 5 is inserted into the heat transfer tube 2 as illustrated in FIG. 7B. The tip end area of the split punch 5 is the tapered portion 51*a* of which tip end is narrowed, so that even if the centers of the split punch 5 and the heat transfer tube 2 are slightly misaligned in case of inserting the split punch 5 into the heat transfer tube 2, the tip end area of the split punch 5 is prevented from being caught by the end portion of the heat transfer tube 2, thereby the split punch 5 is inserted into the heat transfer tube 2 appropriately and surely.

When a plurality of split punches 5 are held by a holder and are concurrently inserted into a plurality of heat transfer tubes 2, the centers of the heat transfer tubes 2 and the centers of the split punches 5 are often misaligned. However, in the embodiment of the present invention, the split punches 5 are appropriately inserted into the heat transfer tubes 2 in such a case. The deformable portion 50 of the split punch 5 is enlarged under the state illustrated in FIG. 7B, and the first and the second annular convex portions 21, 22 are formed appropriately for the heat transfer tubes 2 as illustrated in FIG. 7C.

Figure 8A:
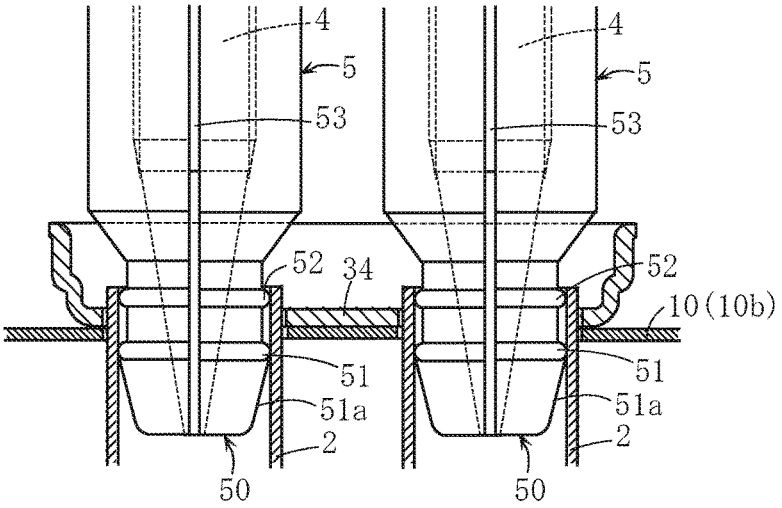
FIG. 8A and FIG. 8B are essential sectional views illustrating one embodiment of process procedures of a region illustrated in FIG. 6.
Figure 8B:
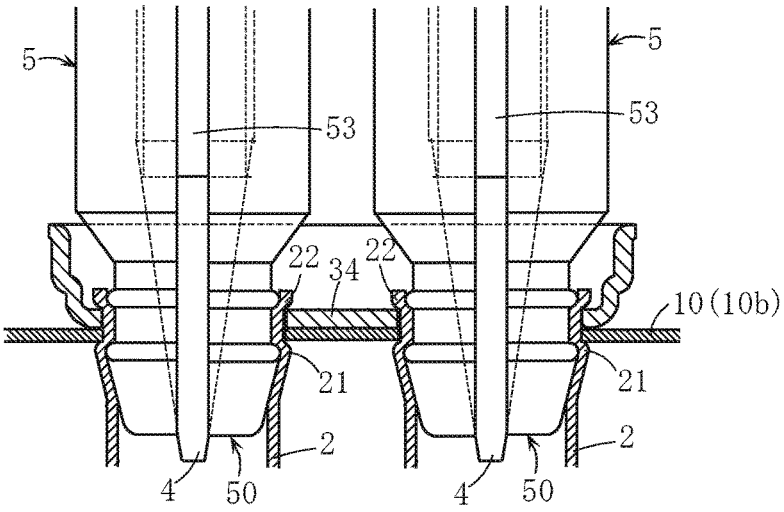
Figure 9A:
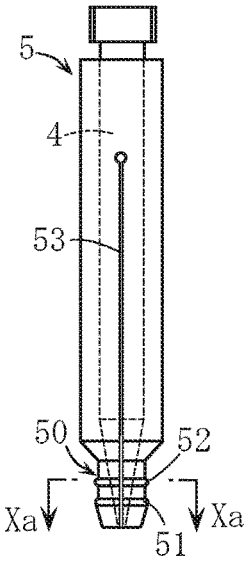
FIG. 9A is a front view illustrating one embodiment of a split punch used for an expanding process of a heat transfer tube.
Figure 9B:
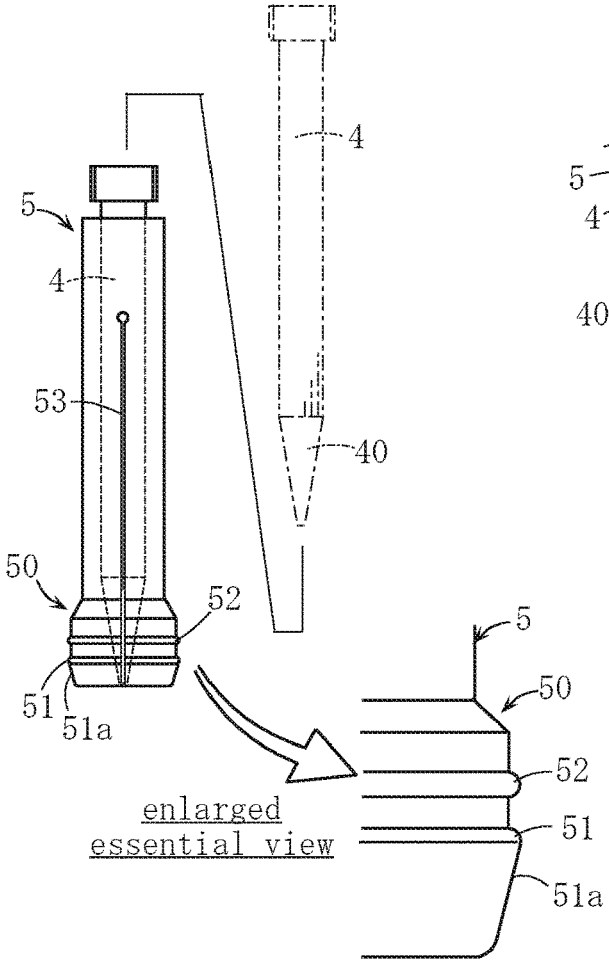
FIG. 9B is its side view.
Figure 9C:
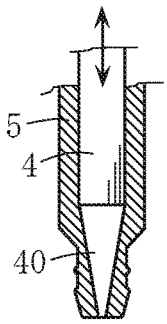
FIG. 9C is a plan sectional view of an essential part of FIG. 9A.

On the other hand, for obtaining the second fixing structure illustrated in FIG. 6, the tube expansion operation is executed using the above-mentioned split punch 5 as illustrated in FIG. 8A and FIG. 8B and the first and the second annular convex portion 21, 22 are provided for the heat transfer tube 2.

After completing the tube expansion operations, the header cover member 35 is attached to the header base member 34. In case of producing the heat exchanger HE, the tube expansion operations illustrated in FIG. 7A to FIG. 7C, FIG. 8A and FIG. 8B are simultaneously executed for a plurality of heat transfer tubes 2. Thus, the productivity of the heat exchanger HE is improved and the production cost is reduced. Although the above-mentioned explanation does not refer to the case when the first and the second annular convex portions 21, 22 are provided for the circular outer heat transfer tube 2A, the basic structure of operation procedures for providing the first and the second annular convex portions 21, 22 for the circular outer heat transfer tube 2A is the same as that for the inner heat transfer tube 2.

In the heat exchanger HE of the embodiment of the present invention, the side plate portion 10 of the case 1, the heat transfer tubes 2, 2A, and the header 3 (header base member 34) are relatively fixed in an appropriate manner by a simple structure in which the first and the second annular convex portions 21, 22 are provided for the heat transfer tubes 2, 2A. The first and the second annular convex portions 21, 22 are easily and rapidly formed by providing the expansion procedure to the heat transfer tubes 2, 2A using the split punch 5 and the number of the members of the heat exchanger HE does not increase. Therefore, it is advantageous that the production cost of the heat exchanger HE is reduced.

The present invention is not limited to the above-mentioned preferred embodiments. The specific configuration of the members of the heat exchanger of the present invention is freely designed within the intended scope of the present invention. The specific configuration of the production procedure of the heat exchanger of the present invention is freely designed within the intended scope of the present invention.

In the present invention, two types of heat transfer tubes are not always necessary. One type of heat transfer tube can be used. Further, the heat transfer tube is not limited to a straight type, and it can be meandering or spiral. All of the attachment portions of a plurality of headers provided for the heat exchanger is preferably configured in accordance with the intended scope of the present invention; however, the technical scope of the present invention is satisfied when at least some of the header attachment structures are configured in accordance with the intended scope of the present invention. The technical scope of the present invention is satisfied when at least one of the first and the second fixing structures illustrated in FIG. 5 and FIG. 6 is provided.

The invention claimed is:

1. A heat exchanger comprising:

a case having a side plate portion through which a first hole portion penetrates, a heating medium being supplied into the case;

a heat transfer tube, an end portion of the heat transfer tube being inserted into the first hole portion;

a header constituting member provided on an outer face side of the side plate portion, the header constituting member having a second hole portion into which the end portion of the heat transfer tube is inserted; and a first annular convex portion and a second annular convex portion that are provided for the heat transfer tube, outer diameters of the first and the second annular convex portions being partially expanded, the first and the second annular convex portions relatively fixing the side plate portion of the case, the heat transfer tube, and the header constituting member, wherein the first annular convex portion is positioned on an inner face side of the side plate portion and is engaged with a circumferential edge portion of the first hole portion, or the first annular convex portion is positioned in the first hole portion and contacts under pressure with an inner circumferential face of the first hole portion, and the second annular convex portion is positioned on an outer face side of the header constituting member and is engaged with a circumferential edge portion of the second hole portion.

2. The heat exchanger as set forth in claim 1, further comprising at least one header for water inflow or water outflow of the heat transfer tube, the header comprising:

a header base member having a first base plate portion in a flat shape and a first flange portion in an annular shape, the first base plate portion being arranged along the outer face of the side plate portion of the case, the first flange portion being connected to an outer circumferential edge of the first base plate portion and rising outward; and a header cover member having a second base plate portion in a flat shape and a second flange portion in an annular shape, the second base plate portion facing the first base plate portion, the second flange portion being connected to an outer circumferential edge of the second base plate portion and being fitted to the first flange portion, wherein the first base plate portion is provided with the second hole portion and the header base member comprises the header constituting member.

3. The heat exchanger as set forth in claim 1, the first annular convex portion has a tapered portion extending in an axial length direction of the heat transfer tube in such a manner that an outer diameter of the tapered portion is reduced toward an inner side of the case.

4. The heat exchanger as set forth in claim 3, wherein the side plate portion and the header constituting member are arranged so as to be apart from each other in the axial length direction of the heat transfer tube, a part of the first annular convex portion close to an outer side of the case is positioned on an outer side of the side plate portion and is engaged with an inner face side of the header constituting member, so that a part of the header constituting member is interposed between the first and the second annular convex portions, and the tapered portion of the first annular convex portion contacts under pressure with the inner circumferential face of the first hole portion.

5. The heat exchanger as set forth in claim 4, wherein a spacer is interposed between the side plate portion and the header constituting member, the spacer having a third hole portion into which the heat transfer tube is inserted, and the tapered portion also contacts under pressure with an inner circumferential face of the third hole portion.

6. The heat exchanger as set forth in claim 1, wherein the heat transfer tube comprises an inner heat transfer tube arranged in the case and an outer heat transfer tube arranged outside of the case so as to contact with an outer face portion of the case, and the first and the second annular convex portions are provided for each of the inner heat transfer tube and the outer heat transfer tube.

7. The heat exchanger as set forth in claim 6, wherein the inner and the outer heat transfer tubes are communicated with each other and are configured in such a manner that water supplied into one of the inner and the outer heat transfer tubes passes through the other of the inner and the outer heat transfer tubes.

8. The heat exchanger as set forth in claim 1, wherein the header constituting member is configured to contact with an outer face portion of the side plate portion, and a part of the header constituting member and a part of the side plate portion are respectively interposed between the first and the second annular convex portions.

9. A production method of a heat exchanger, the production method comprising the steps of:

inserting an end portion of a heat transfer tube into a first hole portion provided for a side plate portion of a case in which a heating medium is supplied and into a second hole portion of a header constituting member arranged on an outer face side of the side plate portion; and relatively fixing the side plate portion, the heat transfer tube, and the header constituting member;

wherein, in the fixing step a first annular convex portion and a second annular convex portion are provided by partially expanding at least two portions of the heat transfer tube, the first annular convex portion being positioned on an inner face side of the side plate portion and being engaged with a circumferential edge portion of the first hole portion, or the first annular convex portion being positioned in the first hole portion and contacting under pressure with an inner circumferential face of the first hole portion, the second annular convex portion being positioned on an outer face side of the header constituting member and being engaged with a circumferential edge portion of the second hole portion.

10. The production method of the heat exchanger as set forth in claim 9, wherein the heat transfer tube is expanded by a split punch, and the split punch has a deformable portion divided into a plurality of segments around a central axis, and an outer circumferential face of the deformable portion has a first convex portion and a second convex portion for respectively forming the first and the second annular convex portions.

11. The production method of the heat exchanger as set forth in claim 10, wherein the split punch has the first convex portion at a tip end portion, and the first convex portion has a tapered portion extending in an axial length direction of the split punch in such a manner that an outer diameter of the tapered portion is reduced toward a tip end side.

12. The production method of the heat exchanger as set forth in claim 10, wherein the heat transfer tube comprises an elliptic tube, and the split punch is configured in such a manner that outlines of the first and the second convex portion are elliptic corresponding to the elliptic tube seen along an axial length direction, and a slit for dividing the deformable portion into the segments is in a shape of cross with a long axis and a short axis of ellipse.

13. The production method of the heat exchanger as set forth in claim 10, wherein a plurality of heat transfer tubes are used as the heat transfer tube, and a plurality of split punches are used as the split punch and are simultaneously expand the plurality of heat transfer tubes.

* * * * *